US011473359B2

(12) United States Patent
Windmann

(10) Patent No.: US 11,473,359 B2
(45) Date of Patent: Oct. 18, 2022

(54) COVER ELEMENT FOR A HINGE AND CORRESPONDING HINGE

(71) Applicant: Bohle AG, Haan (DE)

(72) Inventor: Frank Windmann, Langenfeld (DE)

(73) Assignee: Bohle AG, Haan (DE)

( * ) Notice: Subject to any disclaimer, the term of this patent is extended or adjusted under 35 U.S.C. 154(b) by 0 days.

(21) Appl. No.: 17/200,716

(22) Filed: Mar. 12, 2021

(65) Prior Publication Data

US 2021/0285271 A1 Sep. 16, 2021

(30) Foreign Application Priority Data

Mar. 13, 2020 (DE) ..... 202020101419.6

(51) Int. Cl.
*E05D 11/00* (2006.01)

(52) U.S. Cl.
CPC ..... *E05D 11/0054* (2013.01); *E05Y 2201/11* (2013.01); *E05Y 2600/622* (2013.01); *E05Y 2900/531* (2013.01)

(58) Field of Classification Search
CPC . E05D 11/00; E05D 11/0054; E05D 11/0063; E05D 11/0072; E05D 7/04; E05D 7/0415; E05D 7/0423; E05D 7/0027; E05D 7/0009; E05D 2007/0492; E05Y 2900/40; E05Y 2900/31; E05Y 2201/11; E05Y 2600/622; E05Y 2900/531; E05Y 2011/0063; Y10T 16/533; Y10T 16/5335; Y10T 16/5321; Y10T 16/5322; Y10T 16/53225; Y10T 16/558
See application file for complete search history.

(56) References Cited

U.S. PATENT DOCUMENTS 2,873,454 A * 2/1959 Phillips ..... A47K 13/04 4/248
4,917,423 A * 4/1990 Kohn ..... G09F 3/0317 292/324
5,630,611 A * 5/1997 Goss ..... B60R 21/2035 280/728.2
5,639,113 A * 6/1997 Goss ..... B60R 21/2035 280/728.2

(Continued)

FOREIGN PATENT DOCUMENTS

AT 373 966 9/1979
DE 20 2012 001 745 U1 5/2012

(Continued)

*Primary Examiner* — Chuck Y Mah
(74) *Attorney, Agent, or Firm* — Patent Technologies, LLC; Robert D. Gunderman, Jr.

(57) ABSTRACT

The invention relates to a cover element for a hinge, which comprises at least one hinge area to be clad, in which blind hole-like recesses are formed, wherein the cover element comprises a plane base body for the outer cladding of the hinge area. The invention further relates to a hinge, in particular for a door, comprising at least one hinge axis element, a first hinge part and a second hinge part, which are connected to one another in a hinge-like manner via the at least one hinge axis element and at least one cover element with a plane base body for the outer cladding of a respective hinge area, wherein blind hole-like recesses are firmed in the hinge area of the respective hinge part to be clad.

9 Claims, 3 Drawing Sheets

(56) References Cited

U.S. PATENT DOCUMENTS

| | | | | |
|---|---|---|---|---|
| 5,931,838 | A * | 8/1999 | Vito | F16B 21/18 606/281 |
| 2004/0098835 | A1 | 5/2004 | Elmer | |
| 2004/0261222 | A1 | 12/2004 | Elmer | |
| 2005/0198776 | A1* | 9/2005 | Elmer | E05D 5/0246 16/252 |
| 2008/0104799 | A1 | 5/2008 | Hoppe et al. | |
| 2010/0088850 | A1 | 4/2010 | Dringenberg | |
| 2012/0013170 | A1* | 1/2012 | Renius | B60B 7/065 301/37.102 |
| 2016/0090768 | A1* | 3/2016 | Mooers | E05D 11/0054 16/251 |
| 2018/0298657 | A1* | 10/2018 | Kim | E05D 3/02 |

FOREIGN PATENT DOCUMENTS

| | | | | |
|---|---|---|---|---|
| EP | 1 253 273 | A2 | 10/2002 | |
| EP | 2 927 407 | A1 | 10/2015 | |
| EP | 3173560 | A1 * | 5/2017 | E05D 11/0054 |
| GB | 2381291 | A * | 4/2003 | E05D 11/0054 |
| GB | 2 481 912 | A | 1/2012 | |

* cited by examiner

COVER ELEMENT FOR A HINGE AND CORRESPONDING HINGE

CROSS REFERENCE TO RELATED PATENT APPLICATIONS

This application claims priority to German Patent Application DE202020101419.6 filed on Mar. 13, 2020 entitled "Abdeckelement für ein Gelenkband und entsprechendes Gelenkband" (Cover Element For a Hinge and Corresponding Hinge) by Frank Windmann, the entire disclosure of which is incorporated herein by reference in its entirety.

BACKGROUND OF THE INVENTION

1. Field of the Invention

This invention relates generally to a hinge, and more specifically to a cover element for a hinge.

2. Description of Related Art

Hinges such as shower door hinges usually consist of an arrangement of functional components such as hinge parts that ensure connection to a fixed part (wall, glass partition), hinge parts that hold the door leaf in place, hinge axis elements that enable the rotary movement or parts that realize a zero position reset. At least some of these functional components are covered/clad with decorative (e.g. bright chrome-plated) cover elements, also called covers, after assembly.

A possibility, customary in the market, of attaching the respective cover element/cover is the introduction of a locking nose and an undercut in the cover element/cover and the realization of a ball pressure piece at the hinge body.

However, the decorative cover elements/covers alone are not decisive for a pleasing appearance. What is important is the optically precise positioning of the cover elements/covers in relation to one another or in relation to the visible surfaces of the functional components. The realization of small clearances is particularly desirable here. Furthermore, the positioning of the cover elements/cover of the respective fixed part and the movable part relative to one another plays a role.

A sufficiently precise positioning of the cover elements/covers cannot be achieved with the commercially available ball pressure piece solutions. In particular, it must be ensured that the covers on the movable hinge part reliably have a sufficient distance from the fixed hinge body parts so that during a movement of the hinge no component collisions occur and the cover elements/covers are sheared off.

With adhesive pads, depending on the skill of the installer, a quite precise positioning of the cover elements/covers can be achieved, but the assembly of the cover elements/cover is comparatively complex, and, moreover, the durability of the adhesive connection under the influence of the application "shower", that is the influence of water, steam, soap, detergents, etc., is at least questionable.

The document CP 2 722 472 A2 shows a hinge for a swing door, more precisely a shower swing door, comprising (i) at least one hinge axis element, (ii) a first hinge part and a second hinge part, which are hinge-like connected to one another via the at least one hinge axis element and (iii) cover elements with a respective plane base body for the outer cladding of a respective hinge area, wherein access holes are formed in the hinge areas of the respective hinge part to be clad, via which adjusting screws can be operated. The cover elements are connected to the respective hinge parts via small pins. Here, the cover elements are clipped onto these small pins, wherein the small pins are in particular spring-loaded.

It is one object of the present invention to provide a cover element for a hinge and a corresponding hinge, in which a precise alignment of the respective cover element at the hinge can be realized easily and permanently.

This object is achieved according to the invention by the features of the independent claims. Preferred embodiments of the invention are further specified in the sub claims, which, each individually or in combination, can represent an aspect of the invention.

BRIEF SUMMARY OF THE INVENTION

In the cover element according to the invention for a hinge comprising at least one hinge area to be clad, in which blind hole-like recesses are formed, which comprises a plane base body for the outer cladding of the hinge area, dome-shaped protruding structures tor insertion into the blind hole-like recesses and elastic O-rings attached to the dome-shaped protruding structures are provided, wherein by means of the O-rings a circumferential contact between the respective blind hole-like recess (of the hinge part area) and the protruding structure (of the cover element) inserted therein is provided. In other words, the exact alignment of the hinge component to be clad relative to the cover element takes place via these elastic O-rings.

With the solution according to the invention, even in the hinge area to be clad blind hole-like recesses (for example, the access holes for the adjusting screws in the hinge shown in document EP 2 722 472 A2 mentioned at the beginning) can also be used for fastening the cover element.

According to a preferred embodiment of the cover element according to the invention it is provided that at least one, in particular each of the dome-shaped protruding structures comprises an annular groove in which a part of the respective elastic O-ring rests. The elastic O-ring is thus arranged at the protruding structures of the annular groove of the cover element and is usually also replaced when the cover element is replaced.

It is advantageously provided that the dome-shaped protruding structures are formed integral with the plane base body. The dome-shaped protruding structures are created in particular by a chip-removing post-processing of a corresponding blank of the cover element.

In the hinge according to the invention, which is in particular a hinge for a door and which comprises (i) at least one hinge axis element, (ii) a first hinge part and a second hinge part, which are connected to one another in a hinge-like manner via the at least one hinge axis element, and (iii) at least one cover element comprising a plane base body for the outer cladding of a respective hinge area, wherein blind hole-like recesses are formed in the hinge area to be clad of the respective hinge part and/or hinge axis element, it is provided that the corresponding cover element comprises dome-shaped protruding structures for insertion into the blind hole-like recesses, wherein the circumferential contact between the respective recess and the protruding structure inserted therein takes place via an elastic O-ring. In other words, the exact alignment of the hinge component to be clad relative to the cover element takes place via these elastic O-rings. The hinge area to be clad can be an area of one of the hinge parts or an area of the hinge axis element.

According to a preferred embodiment of the hinge according to tire invention it is provided that the cover element or at least one of the cover elements is an abovementioned cover element.

According to a further preferred embodiment of the hinge according to the invention, the blind hole-like recesses and the corresponding dome-shaped protruding structures are designed in such a way that they connect the respective hinge part or hinge axis element on the one hand and the corresponding cover element on the other hand via the respective elastic O-rings with respect to the insertion direction in a force-fitting and/or positively locked manner. In other words, the firm connection between hinge part and cover element is realized via the respective clastic O-ring.

In principle, it is conceivable that the O-rings are attached in the blind hole-like recesses. According to yet another preferred embodiment of the hinge according to the invention, however, it is provided that at least one, in particular each of the dome-shaped protruding structures has an annular groove in which a part of the respective elastic O-ring rests. The elastic O-ring is arranged at the protruding structures of the cover element and is replaced when the cover element is replaced.

Furthermore, with regard to the hinge, it is preferably provided that into at least one, in particular in each, of the blind hole-like recesses at least one nose structure of the corresponding hinge part or hinge axis element protrudes, which is designed such that it engages behind the O-ring when the dome-shaped protruding structure is inserted. In this way, a defined form fit in the connection is achieved.

Finally, with regard to the hinge, it is advantageously provided that the cover element or at least one of the cover elements overlaps the corresponding hinge part or hinge axis element laterally. For this purpose, the cover element comprises, for example, a protruding edge.

The foregoing has been provided by way of introduction, and is not intended to limit the scope of the invention as further described in this specification and the attached drawings and claims.

BRIEF DESCRIPTION OF THE DRAWINGS

The invention is explained by way of example with reference to the attached drawings based on preferred exemplary embodiments, wherein the features shown below both individually and in combination may represent an aspect of the invention. In the drawings.

The present invention will be described in connection with a preferred embodiment, however, it will be understood that there is no intent to limit the invention to the embodiment described. On the contrary, the intent is to cover all alternatives, modifications, and equivalents as may be included within the spirit and scope of the invention as defined by specification and the attached drawings and claims.

DESCRIPTION OF THE PREFERRED EMBODIMENTS

For a general understanding of the present invention, reference is made to the drawings. The present invention will be described by way of example, and not limitation. Modifications, improvements and additions to the invention described herein may be determined after reading this specification and viewing the accompanying drawings; such modifications, improvements, and additions being considered included in the spirit and broad scope of the present invention and its various embodiments described or envisioned herein.

The present invention relates to a cover element for a hinge, which comprises at least one hinge area to be clad, in which blind hole-like recesses are formed, wherein the cover element comprises a plane base body for the outer cladding of the hinge area.

The present invention further relates to a hinge, in particular for a door, comprising (i) at least one hinge axis element, (ii) a first hinge part and a second hinge part, which are connected to one another in a hinge-like manner via the at least one hinge axis element and (iii) at least one cover element with a plane base body for the outer cladding of a respective hinge area, wherein blind hole-like recesses are formed in the hinge area of the respective hinge part to be clad.

In the following, the present invention is explained by way of example with reference to the attached drawings based on preferred exemplary embodiments, wherein the features presented below can both individually and in combination represent an aspect of the invention.

Figure 1:
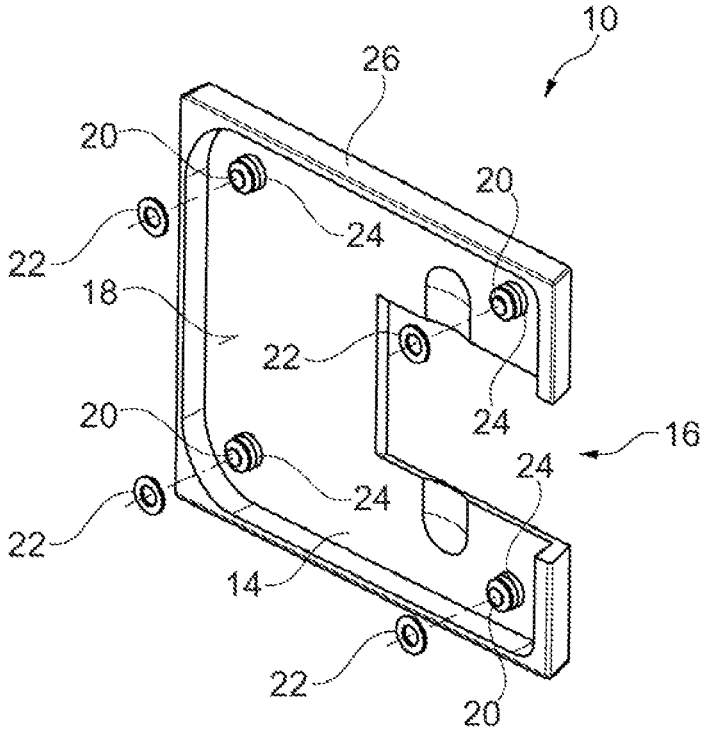
FIG. 1 shows the parts of a cover element for a hinge according to a preferred embodiment of the invention.
Figure 3:
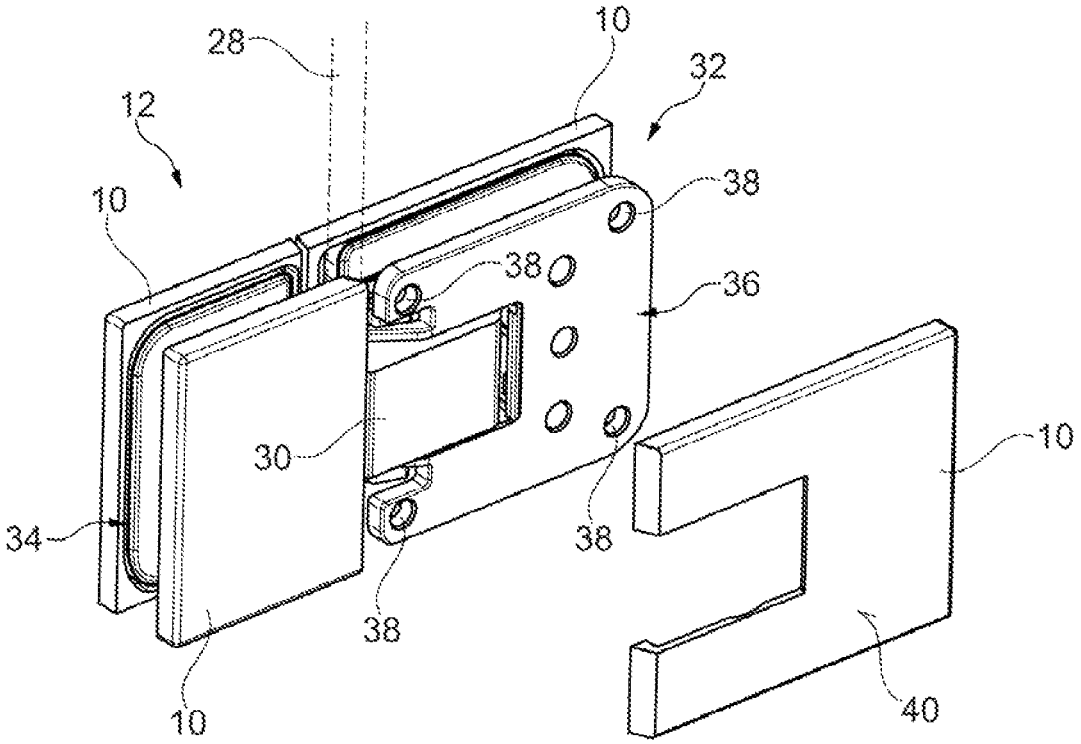
FIG. 3 shows the parts of a hinge according to a preferred embodiment of the invention.
Figure 5:
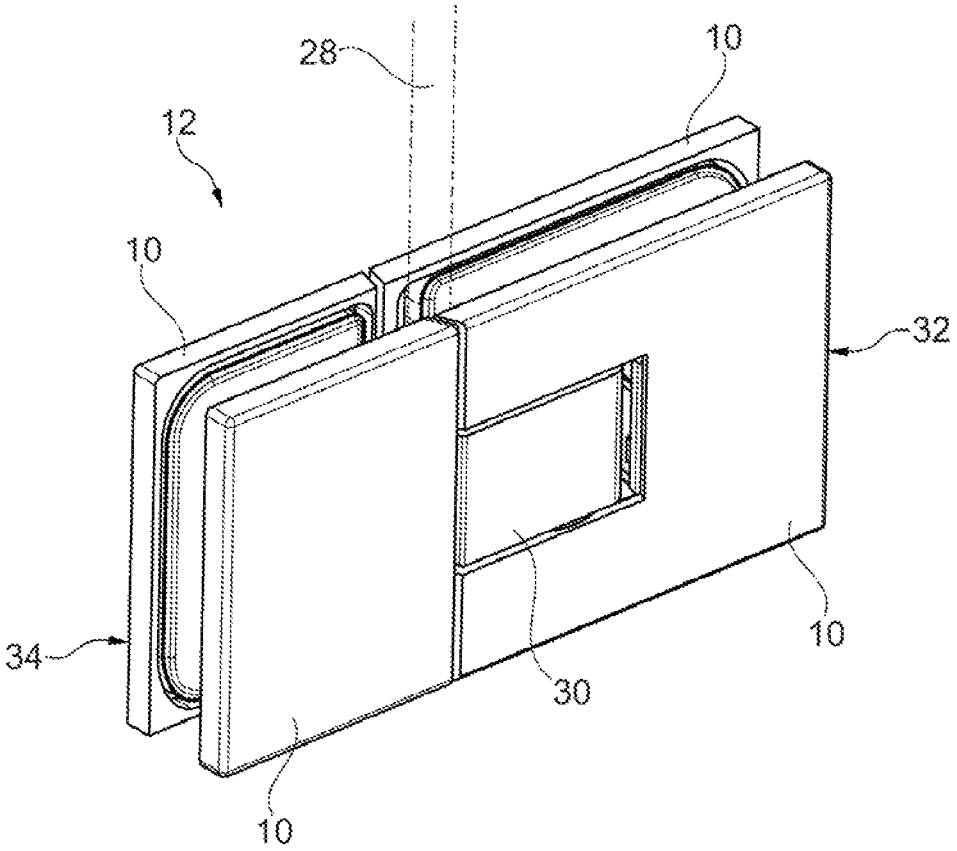
FIG. 5 shows a complete hinge according to a preferred embodiment of the invention.

FIG. 1 shows a cover element 10 for a hinge 12 shown in FIGS. 3 and 5. The cover element 10 shown here comprises a plane base body 14 which is formed roughly C-shaped or U-shaped due to a recess 16. In general, however, the cover element 10 can also have a different shape. On one side 18 (inside) of the cover element 10 or its base body 14 shown here in FIG. 1 several (in the example four) dome-shaped protruding structures 20 (abbreviated: domes) are formed. The dome-shaped protruding structures 20 are arranged spaced apart from one another and distributed over the surface of the base body 14. Each of these protruding structures 20 is roughly in the shape of a cylinder. Here, the dome-shaped protruding structures 20 are formed integral with the plane base body 14. The cover element 10 furthermore comprises a number of elastic O-rings 22, which are shown here separately in FIG. 1, corresponding to the number of dome-shaped protruding structures 20. Each of the dome-shaped protruding structures 20 comprises an annular groove 24 in which a part of the respective elastic O-ring 22 can rest. The respective annular groove 24 is formed in the outer surface of the cylinder shape of the corresponding dome-shaped protruding structure 20 and encompasses it over its entire circumference.

The cover element 10 moreover comprises a protruding edge 26 on one side in the edge region of the plane base body 14. This protruding edge 26 is present almost completely over the entire circumference, only in the area of the recess 16 there is no such edge 26.

Figure 2:
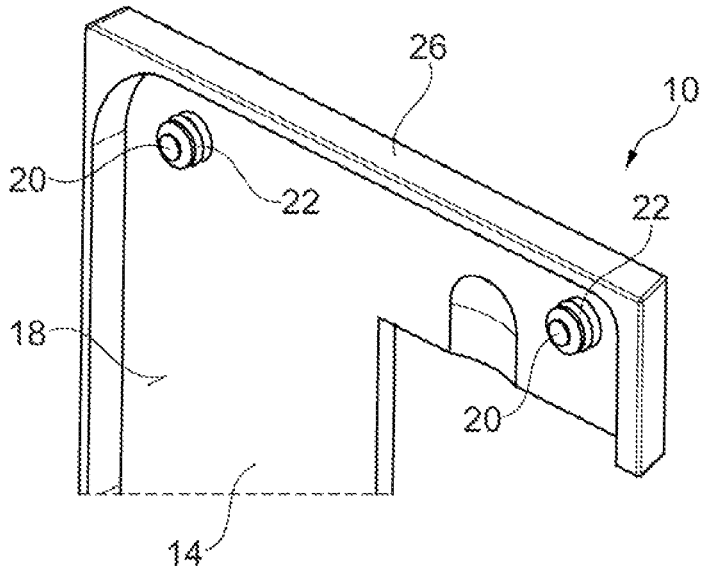
FIG. 2 shows a section of the cover element for a hinge according to a preferred embodiment of the invention.

FIG. 2 now shows a section of the complete cover element 10, in which the clastic O-rings 22 rest in the annular grooves 24, whereby they are held or attached to the dome-shaped protruding structures 20.

FIG. 3 shows the parts of the hinge 12 already mentioned in connection with FIG. 1, as well as a door leaf 28 designed as a glass door leaf, to which the hinge 12 is fastened by clamping.

The hinge 12 shown here is a hinge 12 for a swing door, more precisely for a shower swing door. The hinge 12 comprises the following assemblies of functional components: a hinge axis element 30, a first hinge part 32 and a second hinge part 34, which are connected to one another in a hinge-like manner via the hinge axis element 30, as well as cover elements 10 with plane base bodies 14 for the outer cladding of respective hinge areas 36 of the individual hinge parts 32, 34 and/or also of the hinge axis element 30. The hinge parts 32, 34 shown here each serve a clamping function and the hinge axis element 30 a hinge function.

One of the cover elements 10 has not yet been mounted and will be examined in more detail below as an example. This cover element 10 is the cover element 10 shown in FIGS. 1 and 2, which is intended to cover/clad a hinge area 36 of the first hinge part 32 to be covered. In the hinge area 36 to be covered, blind hole-like recesses 38 are formed. The number and arrangement of these blind hole-like recesses 38 correspond to the number and arrangement of the dome-shaped protruding structures 20 of the cover element 10.

The dome-shaped protruding structures 20 of the cover element 10 are provided for insertion into the blind hole-like recesses 38 in the hinge area 36 to be clad of the corresponding hinge part 32, 34, that is to say here of the first hinge part 32. After assembly, some areas of the functional components are covered by the cover elements 10, so that only the decorative (e.g. bright chrome-plated) other side 40, i.e. the outside visible after assembly, of the respective cover element (cover) is visible.

The circumferential contact between the respective blind bole-like recess 38 and the dome-shaped protruding structure 20 inserted therein takes place via the corresponding elastic O-ring 22. This situation is shown in FIGS. 4 and 5.

Figure 4:
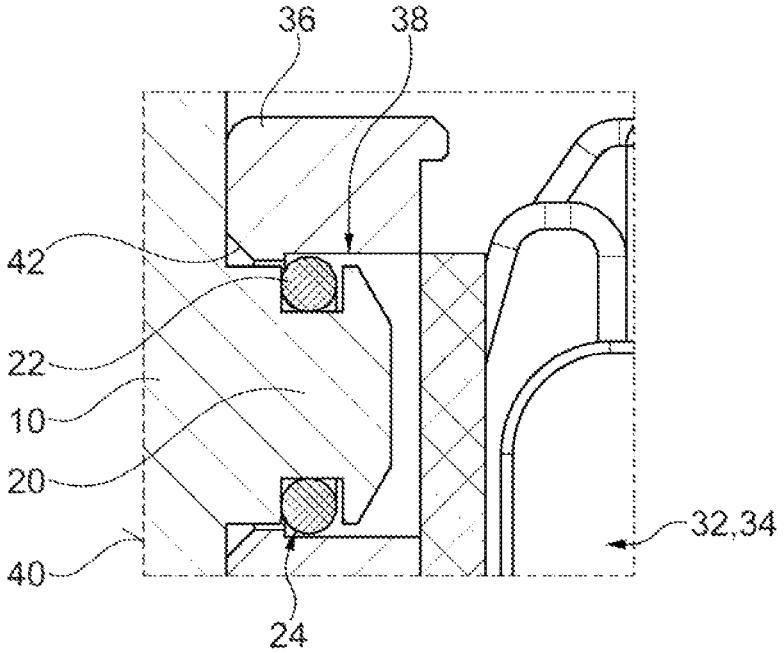
FIG. 4 shows the connection between the cover element and the corresponding hinge part of the hinge in a sectional view.

FIG. 4 shows the connection between the cover element 10 and the corresponding hinge part 32, 34 of the hinge 12 in a sectional view. Only a section of the hinge part 32 with a blind hole like recess 38 and a dome-shaped protruding structure 20 of the cover element 10 inserted therein is shown. As already mentioned, the elastic O-ring 22 rests in the annular groove 24 of the corresponding dome-shaped protruding structure 20. The blind hole-like recess 38 and the corresponding dome-shaped protruding structure 20 are designed to match each other in such a way that they connect the respective hinge pan 32, 34 and the corresponding cover element 10 via the corresponding elastic O-ring 22 with respect to the insertion direction in a form-fitting or positively locked manner. For the form fit, the corresponding hinge part 32, 34 comprises one or more nose structures 42, which protrude into the blind hole-like recess 38 in such a way that, when the dome-shaped protruding structure 20 is inserted, it engages behind the O-ring 22 and thus ensures the corresponding form lit.

Finally, FIG. 5 shows the complete hinge 12, in which all hinge areas 36 to be covered or to be clad are covered by cover elements 10 or clad by means of these cover elements 10.

Hereinafter the solution according to the invention and its advantages are described again in other words. This solution enables the cover elements 10 (cover) to be positioned very precisely in, relation to one another as well as in relation to the functional components of the hinge 12, wherein the cover elements 10 at the same time can be assembled very easy.

To this end, first the usual manufacturing process for shower door hinge bands must be discussed. Usually, the components of shower door hinges are first manufactured by means of the original molding process (e.g. hot pressing, casting) and then imparted with further functional contours or selectively inure precise dimensions by chip-removing post-processing. In this way for example, the attachment of the cover is realized by use of a pressure piece.

In the present solution, the dome-shaped protruding structures 20 (dome for short) with the groove 24 are produced in the chip-removing post-processing on the inside (side 18) of the respective cover elements 10, which are already present oversized in the blank of the cover element 10. An O-ring 22 is placed on each of these domes 20. Corresponding O-rings are available in these dimensions as a mass-produced product also with a fully adequate chemical resistance.

In the respective counterparts of the hinge parts 32, 34, the blind hole-like recesses 38 are introduced as bores, which are provided with the small undercut (nose structure 42). These holes, too, are thrilled precisely in connection with the chip-removing processing. In addition, the functional components of the hinge parts 32, 34 and/or of the hinge axis element 30 have sufficiently precisely manufactured geometries that enable the components to be precisely assigned to one another, including to those opposite through the glass pane.

The cover elements 10 are now pinned on the respective functional components of the respective hinge part 32, 34 or binge axis element 30. The O-ring 22 deforms elastically and engages in the undercut 42 of the bore 38 on the functional component.

In principle, the cover elements 10 can also be removed again if necessary, e.g. for cleaning or maintenance purposes, or in order to replace them with cover elements 10 with a different decorative surface.

REFERENCE SYMBOLS

10 cover element
12 hinge
14 plane body
16 recess
18 side
20 dome-shaped protruding structure
22 O-ring
24 ring groove
26 protruding edge
28 door leave
30 pivot axis element
32 first hinge part
34 second hinge part
36 hinge area
38 blind hole-like recess
40 other side
42 nose structure While the various objects of this invention have been described in conjunction with preferred embodiments thereof, it is evident that many alternatives, modifications, and variations will be apparent to those skilled in the art. Accordingly, it is intended to embrace all such alternatives, modifications and variations that fall within the spirit and broad scope of this specification and the attached drawings and claims.

What is claimed is:

1. A cover element (10) for a hinge (12), which comprises at least one hinge area (36) to be clad, in which blind hole-like recesses (38) are formed, comprising a plane base body (14) for the outer cladding of the hinge area (36), dome-shaped protruding structures (20) for insertion into the blind hole-like recesses (38) and elastic O-rings (22) attached to the dome-shaped protruding structures (20), via which a circumferential contact between the respective recess (38) and the dome-shaped protruding structure (20) inserted therein takes place.

2. The cover element according to claim 1, wherein at least one of the dome-shaped protruding structures (20) comprises an annular groove (24) in which a part of the respective elastic O-ring (22) rests.

3. The cover element according to claim 1, wherein the dome-shaped protruding structures (20) are formed integral with the plane base body (14).

4. The cover element according to claim 3, wherein the dome-shaped protruding structures (20) are produced by chip-removing post-processing of a blank of the cover element (10).

5. A hinge (12) comprising:

at least one hinge axis element (30);

a first hinge part (32) and a second hinge part (34), which are connected to one another in a hinge-like manner via the at least one hinge axis element (30);

at least one cover element (10) with a plane base body (14) for the outer cladding of a respective hinge area (36), wherein blind hole-like recesses (38) are formed in the hinge area (36) to be clad of the respective hinge part (32, 34) and/or hinge axis element (30), and the corresponding cover element (10) comprises dome-shaped protruding structures (20) for insertion into the blind hole-like recesses (38), and wherein the circumferential contact between the respective recess (38) and the protruding structure (20) inserted therein takes place via an elastic O-ring (22).

6. The hinge according to claim 5, wherein the blind hole-like recesses (38) and the corresponding dome-shaped protruding structures (20) are designed such that they connect the respective hinge part (32, 34) or hinge axis element (30) on the one hand and the corresponding cover element (10) on the other hand via the respective elastic O-rings (22) with respect to the insertion direction in a force-fitting and/or positively locked manner.

7. The hinge according to claim 5, wherein at least one of the dome-shaped protruding structures (20) comprises an annular groove (24) in which a part of the respective elastic O-ring (22) rests.

8. The hinge according to claim 7, wherein at least one nose structure (42) of the corresponding hinge part (32, 34) or hinge axis element (30), which is designed in such a way that it engages behind the O-ring (22) when the dome-shaped protruding structure (20) is inserted, protrudes into at least one of the blind hole-like recesses (38).

9. The hinge according to claim 5, wherein the cover element (10) or at least one of the cover elements (10) overlaps the corresponding hinge part (32, 34) or hinge axis element (30) laterally.

* * * * *